US010991560B2

(12) United States Patent
Brown et al.

(10) Patent No.: US 10,991,560 B2
(45) Date of Patent: Apr. 27, 2021

(54) SAMPLE INTRODUCTION SYSTEM FOR SPECTROMETERS

(71) Applicant: Micromass UK Limited, Wilmslow (GB)

(72) Inventors: Jeffery Mark Brown, Hyde (GB); Steve Bajic, Sale (GB); Steven Derek Pringle, Darwen (GB)

(73) Assignee: Micromass UK Limited, Wilmslow (GB)

( * ) Notice: Subject to any disclaimer, the term of this patent is extended or adjusted under 35 U.S.C. 154(b) by 64 days.

(21) Appl. No.: 16/426,894

(22) Filed: May 30, 2019

(65) Prior Publication Data

US 2019/0287778 A1 Sep. 19, 2019

Related U.S. Application Data

(63) Continuation of application No. 15/123,513, filed as application No. PCT/GB2015/050613 on Mar. 3, 2015, now abandoned.

(30) Foreign Application Priority Data

Mar. 4, 2014 (EP) ..... 14157595
Mar. 4, 2014 (GB) ..... 1403753.5

(51) Int. Cl.
*H01J 49/04* (2006.01)
*H01J 49/00* (2006.01)

(52) U.S. Cl.
CPC ..... *H01J 49/045* (2013.01); *H01J 49/0031* (2013.01); *H01J 49/0468* (2013.01)

(58) Field of Classification Search
CPC ... H01J 49/045; H01J 49/0031; H01J 49/0468
See application file for complete search history.

(56) References Cited

U.S. PATENT DOCUMENTS 3,751,660 A * 8/1973 Thurston ..... H01J 49/0413 250/288
4,730,111 A * 3/1988 Vestal ..... G01N 30/7253 250/281
5,877,495 A * 3/1999 Takada ..... H01J 49/0431 250/288
6,534,765 B1 * 3/2003 Robb ..... H01J 49/045 250/282

(Continued)

FOREIGN PATENT DOCUMENTS

WO 2006121534 A1 11/2006

OTHER PUBLICATIONS

"Moving droplets on asymmetrically structured surfaces," Phys Rev E. Sep. 1999; 60(3)2964-72, Sandre et al. (Year: 1999).*

(Continued)

*Primary Examiner* — Sean M Luck
(74) *Attorney, Agent, or Firm* — Womble Bond Dickinson (US) LLP; Deborah M. Vernon; Heath T. Misley

(57) ABSTRACT

A method of mass or ion mobility spectrometry is disclosed that uses the Leidenfrost effect to cause a liquid to be repelled away from a heated surface so as to levitate above there-above. The repelled liquid is urged so as to move along the surface in a predetermined direction, for example, by the geometric configuration of the heated surface.

17 Claims, 2 Drawing Sheets

(56) References Cited

U.S. PATENT DOCUMENTS 6,759,650 B2 * 7/2004 Covey ..... H01J 49/049 250/282
8,440,966 B2 * 5/2013 Choi ..... H01J 49/38 219/121.63
8,695,813 B2 * 4/2014 Carson ..... B01D 1/0094 210/149
9,082,603 B2 * 7/2015 Bajic ..... H01J 49/0445
9,269,554 B2 * 2/2016 Brown ..... H01J 49/0481
2003/0189169 A1 10/2003 Wells et al.
2004/0094706 A1 * 5/2004 Covey ..... G01N 30/724 250/288
2004/0099803 A1 * 5/2004 Tong ..... H01J 49/10 250/288
2004/0256550 A1 * 12/2004 Finch ..... H01J 49/045 250/288
2009/0101814 A1 * 4/2009 Amirav ..... H01J 49/0431 250/288
2009/0294660 A1 * 12/2009 Whitehouse ..... H01J 49/045 250/288
2011/0108726 A1 5/2011 Hiraoka et al.
2012/0312980 A1 * 12/2012 Whitehouse ..... H01J 49/0413 250/282
2012/0326022 A1 * 12/2012 Kumano ..... H01J 49/0409 250/282

OTHER PUBLICATIONS

Bogan et al. "MALDI-TOF-MS Analysis of Droplets Prepared in an Electrodynamic Balance: "Wall-less" "Sample Prepation"." Anal. Chem. 74.3(2002): 489-496.
Cousins et al. "A ratchet trap for Leidenfrost drops." Department of Applied Mathematics and Theoretical Physics, University of Cambridge. 696(Aug. 2011): 215-227.
Embach. "Translatoin of the Tractatus of J.G. Leidenforst by Carolyn Wares (Embach)." 2015.
Lagubeau et al. "Self-propulsion of Leidenfrost drops." PAS Physics. 2008.
Leidenfrost. "De Aquae Communis Nonnullis Qualitatibus Tractatus 1756." With introduction by Colin Pounder. 2015.
Niessen et al. "Strategies in developing interfaces for coupling liquid chromatography and mass spectrometry." J. Chromatogr. 554(1991): 3-26.

* cited by examiner

SAMPLE INTRODUCTION SYSTEM FOR SPECTROMETERS

CROSS REFERENCE TO RELATED APPLICATIONS

This application is a continuation of U.S. application Ser. No. 15/123,513, filed Sep. 2, 2016, which is the National Stage of International Application No. PCT/GB2015/050613, filed 3 Mar. 2015, which claims priority from and the benefit of United Kingdom patent application No. 1403753.5 filed on 4 Mar. 2014 and European patent application No. 14157595.1 filed on 4 Mar. 2014. The entire contents of these applications are incorporated herein by reference.

BACKGROUND TO THE PRESENT INVENTION

The present invention relates to a method and apparatus for introducing liquid samples to the desired location in a mass spectrometer or ion mobility spectrometer.

Various techniques are known for introducing a liquid sample to the desired location in a spectrometer. However, it is desired to provide an alternative means for supplying a liquid sample to the desired location.

It is desired to provide an improved method of mass or ion mobility spectrometry. It is also desired to provide an improved spectrometer.

SUMMARY OF THE PRESENT INVENTION

From a first aspect the present invention provides a method of mass or ion mobility spectrometry comprising:

supplying liquid towards a surface;

heating the surface to a temperature that is sufficiently high to cause a portion of the liquid to vapourise and form vapour between the surface and at least part of the liquid, wherein the formation of said vapour repels said at least part of the liquid away from the surface; and wherein the repelled liquid is urged so as to move along the surface in a predetermined direction;

(i) wherein the surface is geometrically configured in a manner such that the formation of said vapour provides a force on said liquid having at least a component in said predetermined direction, or in the opposite direction to said predetermined direction; and/or (ii) wherein the surface is arranged and configured such that gravity causes said repelled liquid to move in said predetermined direction; and/or (iii) wherein the surface is chemically configured so as to urge the repelled liquid along the surface in the predetermined direction; and/or (iv) wherein the liquid is electrically charged and the method comprises providing an electric field that urges the repelled liquid along the surface in the predetermined direction.

The present invention uses the Leidenfrost effect and is advantageous in that it may be used to transport liquid, preferably liquid droplets, to their desired location. For example, the technique may be used to transport a liquid sample to the desired location in a spectrometer.

It is known to heat surfaces in an ion source of a mass spectrometer in order to assist in vapourising the liquid sample. For example, U.S. Pat. No. 5,877,495 discloses a method in which sample droplets are directed towards the surface of a heated block in order to vapourise the sample into gaseous molecules. However, this method does not use the Leidenfrost effect. Rather, the sample droplets are sprayed at a size and rate such that they are "instantaneously vapourised" without being subjected to the Leidenfrost effect. This is in contrast to the present invention, wherein a portion of the liquid is vapourised so as to form vapour between the heated surface and the liquid so as to repel the liquid away from the surface. Consequently, U.S. Pat. No. 5,877,495 does not disclose that such repelled liquid is urged so as to move along the heated surface. These conventional techniques do not recognise that the Leidenfrost effect can be used to levitate a liquid sample above a surface such that it can be controllably urged to the desired location by applying a force to the levitating liquid sample.

According to the present invention, said liquid is preferably provided to said heated surface in the form of liquid droplets.

The liquid is preferably a solution containing one or more analytes that are analysed in the method of spectrometry. The liquid preferably also comprises a solvent.

The method may comprise subjecting a sample to liquid chromatography and supplying the eluent as said liquid. Additionally, or alternatively, the method may comprise spraying said liquid at said surface.

The method comprises heating said liquid using said heated surface until the liquid partially or complete evaporates.

Preferably, the configuration of the surface urges the repelled liquid in said predetermined direction.

The surface is preferably geometrically configured in a manner such the formation of said vapour provides a force on said liquid in said predetermined direction, or in the opposite direction to said predetermined direction.

The surface preferably has one or more angled portions that are arranged and angled such that the liquid is repelled by the vapour in a direction that has a component in said predetermined direction, or in the opposite direction to said predetermined direction.

It is also contemplated that the liquid may be repelled by the vapour in a direction that has a component in a different direction to said predetermined direction and that is not in the opposite direction to said predetermined direction.

The surface preferably comprises one or more projections that are arranged to have a portion extending at an acute or obtuse angle to said predetermined direction. The surface may have a serrated, saw-tooth or ratchet shaped profile.

Preferably, the formation of said vapour exerts a force on said liquid that causes said liquid to move in said predetermined direction. Alternatively, the Leidenfrost effect may simply cause the liquid to levitate above the heated surface and other means may be used to control or direct the movement of the repelled liquid in the desired direction. For example, the surface may include a groove running in said predetermined direction that channels the repelled liquid in said predetermined direction.

Another means that may be used to control or direct the movement of the repelled liquid in the desired direction includes the surface being arranged and configured such that gravity causes said repelled liquid to move in said predetermined direction.

Alternatively, or additionally, the surface may be chemically configured so as to urge the repelled liquid along the surface in the predetermined direction. For example, at least part of the surface may be hydrophobic or may include a hydrophobic gradient that is arranged and configured to urge the levitating liquid in said predetermined direction.

Alternatively, or additionally, a flow of gas may be provided to urge the repelled liquid along the surface in the predetermined direction.

Alternatively, or additionally, the liquid may be electrically charged and the method may comprise providing an electric field that urges the repelled liquid along the surface in the predetermined direction. The method optionally comprises applying an electrical potential to said liquid and/or said surface so as to electrically charge said liquid; and/or applying an electrical potential to said surface so as to provide said electric field.

The liquid may be subjected to any one, or any combination of any two or more, of the forces described herein above so as to cause the liquid to move in the predetermined direction. Although the net force on the liquid urges the liquid in the predetermined direction, any one or more of the above forces may be caused to act in a different direction to the predetermined direction, such as in the opposite direction. This may be used to control the rate or speed of movement of the liquid along the surface.

It is contemplated that the liquid may be forced in more than one predetermined direction, such as first in one direction and then in another direction.

The heated surface may be used to transport said liquid towards and/or into and/or through an aperture or conduit, such as an inlet aperture of a spectrometer for performing said method of spectrometry.

The liquid may be transported through a tube and said heated surface may form at least part of the inside surface of the tube. Preferably, a gas is flowed through said tube in said predetermined direction, preferably so as to cause said liquid to move in said predetermined direction.

The heated surface may comprises a substantially planar member.

The method may comprise urging said liquid towards and into an aperture or recess in said planar member, or onto a predetermined location on said planar member.

The liquid may be urged via any of the techniques described hereinabove such as, for example, the configuration of the heated surface, a gas flow, or an electric field.) The method may comprise directing the liquid onto a funnel shaped member that comprises said heated surface, said funnel shape being arranged and configured such that said liquid is urged towards a predetermined location on the member or towards an aperture in the member by gravity.

The method may comprise urging the liquid to move only until said liquid reaches a predetermined location. The location may be a recess or aperture in the surface. A plurality of predetermined locations may be provided.

The method may further comprise subjecting said liquid to an ionisation source whilst at said predetermined location(s) so as to generate ions from said liquid. For example, the liquid may be subjected to MALDI or DESI type surface ionisation at said one or more predetermined locations.

The liquid preferably comprises analyte and the method may further comprise using the heated surface to urge the liquid into the ionisation region of a mass or mobility spectrometer, ionising the liquid, and using the mass or mobility spectrometer to analyse the resulting ions.

The method may comprises directing a laser beam at the liquid in the ionisation region so as to form ions from the liquid. The laser beam may result in MALDI.

Preferably, the liquid does not contact the heated surface due to vapour formed between the heated surface and the liquid.

Preferably, the heated surface is heated to a temperate that is hotter than the temperature at which the liquid boils at.

The method may comprise varying or controlling the force that urges the liquid along the surface so as to vary or control the rate of movement of the liquid along the surface, optionally thereby varying or controlling the rate of evaporation of the liquid. For example, the rate or duration over which the liquid is evaporated may be varied or controlled so as to control the size of the liquid droplets. After the droplets have evaporated to the desired size they may be subjected to an ionisation technique, such as for example solvent assisted ionisation (SAI), an impactor ionisation ion source or rapid evaporation ionisation mass spectrometry (REIMS).

The method may comprise providing one or more of the heated surfaces described herein and may use said one or more heated surface to guide a plurality of separate streams of liquid together such that the streams of liquid are mixed. For example, this technique may be used to mix a stream of MALDI analyte droplets with a separate stream of MALDI matrix. Alternatively, the technique may be used to mix trypsin with a sample solution in order to digest the sample.

From a second aspect the present invention provides a method of mass or ion mobility spectrometry comprising:

supplying liquid towards a surface;

heating the surface to a temperature that is sufficiently high to cause a portion of the liquid to vapourise and form vapour between the surface and at least part of the liquid, wherein the formation of said vapour repels said at least part of the liquid away from the surface; wherein the heated surface comprises a substantially planar member; and wherein the repelled liquid is urged so as to move along the surface in a predetermined direction.

The method may comprise urging said liquid towards and into an aperture or recess in said planar member, or onto a predetermined location on said planar member.

The method according to the second aspect may include any one, or any combination of any two or more, of the preferred or optional features described herein in relation to the first aspect of the invention. For the avoidance of doubt, the second aspect of the invention may comprise any of the features described in relation to the first aspect of the invention, except that the second aspect of the invention is not necessarily limited features (i) to (iv) of the first aspect of the invention.

The present invention also provides a mass spectrometer and/or ion mobility spectrometer arranged and configured so as to perform any one of the methods described herein.

Accordingly, the first aspect of the present invention provides a mass or ion mobility spectrometer comprising:

a liquid sample delivery device;

a surface for being heated;

a heater for heating said surface;

a controller configured to control said liquid sample delivery device to supply liquid towards said surface, and control said heater so as to heat the surface to a temperature that is sufficiently high to cause a portion of the liquid to vapourise and form vapour between the surface and at least part of the liquid, wherein the formation of said vapour repels said at least part of the liquid away from the surface; and a mechanism for urging the repelled liquid to move along the surface in a predetermined direction;

(i) wherein said surface is geometrically configured in a manner such that when said vapour is formed it provides a force on said liquid having at least a component in said predetermined direction, or in the opposite direction to said predetermined direction; and/or (ii) wherein the surface is arranged and configured such that, in use, gravity causes said repelled liquid to move in said predetermined direction; and/or (iii) wherein the surface is chemically configured so that, in use, it urges the repelled liquid along the surface in the predetermined direction; and/or (iv) wherein the spectrometer further comprises a device for electrically charging the liquid and electrodes for providing an electric field that urges the electrically charged, repelled liquid along the surface in the predetermined direction.

The heater is preferably configured to heat the surface to a temperature of ≥70° C., ≥80° C., ≥90° C., ≥100° C., ≥150° C., ≥200° C., ≥300° C., ≥400° C.

The second aspect of the present invention provides a mass or ion mobility spectrometer comprising:

a liquid sample delivery device;

a substantially planar surface for being heated;

a heater for heating said surface;

a controller configured to control said liquid sample delivery device to supply liquid towards said surface, and control said heater so as to heat the surface to a temperature that is sufficiently high to cause a portion of the liquid to vapourise and form vapour between the surface and at least part of the liquid, wherein the formation of said vapour repels said at least part of the liquid away from the surface; and a mechanism for urging the repelled liquid to move along the surface in a predetermined direction.

The heater is preferably configured to heat the surface to a temperature of ≥70° C., ≥80° C., ≥90° C., ≥100° C., ≥150° C., ≥200° C., ≥300° C., ≥400° C.

The present invention also relates to the combination of the spectrometer described herein and said liquid.

The spectrometer described herein may comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; and (xxvi) a Solvent Assisted Inlet Ionisation ("SAII") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The spectrometer may comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The spectrometer may comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide is preferably maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

The preferred embodiment of the invention relates to an improved fluidic manipulation technique for mass spectrometry that uses the Leidenfrost effect. For example, the effect can be exploited for sample introduction into an ambient ionisation region of a mass spectrometer. Example ionisation regions include a heated inlet tube, an ESI ionising spray or a laser beam target for MALDI.

The invention may be used to reduce cross-contamination or carryover between liquid samples being analysed as the Leidenfrost effect may be used to prevent the liquid from contacting the heated surface that the samples are moved along.

The heated surface may be a relatively large catchment area remote from the spectrometer and the droplet sample may be injected onto the catchment area. The heated catchment area may then direct the liquid into the spectrometer or a desired location in the spectrometer. This renders the process of sample introduction easier and more tolerant to mechanical alignment.

The heated surface may be used to improve control of the rate of desolvation of liquid droplets and/or improve transit time of liquid droplets into a spectrometer.

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENT

Figure 1:
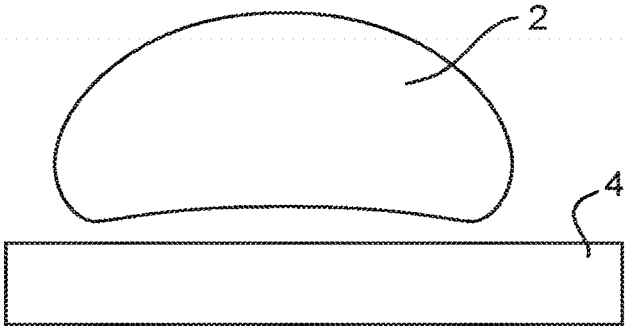
FIG. 1 shows a liquid droplet being subjected to the Leidenfrost effect.

FIG. 1 illustrates the principle of the Leidenfrost effect. The Leidenfrost effect occurs when a drop of liquid 2 is in near contact with a surface 4 that is hot enough to rapidly vapourise the liquid. The rapidly generated vapour forms a layer between the hot surface 4 and the drop of liquid 2 that causes the drop 2 to levitate above the hot surface 4. Typically, the drop 2 may be levitated 0.1 to 0.2 mm above the surface 4. This layer of vapour between the drop of liquid 2 and hot surface 4 has the effect of thermally insulating the drop 2 from the hot surface 4. The rate of evaporation of the drop 2 is therefore reduced, as compared to a drop in contact with the hot surface 4. Depending on the size of the drop of liquid 2, it can take several minutes to evaporate. By way of example, the Leidenfrost effect can be observed when drops of liquid are placed in a very hot saucepan and the drops are then seen to jump around the saucepan. In addition to liquids, the Leidenfrost effect can also be observed for sublimating solids.

Figure 2:
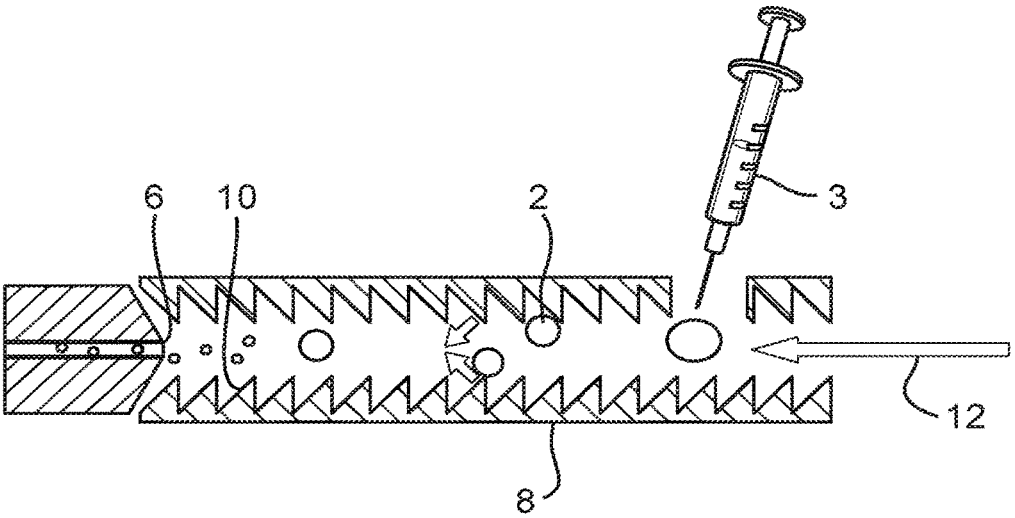
FIG. 2 shows a preferred embodiment of the present invention in which liquid droplets are urged towards an inlet aperture of a mass spectrometer by the Leidenfrost effect.

FIG. 2 shows a preferred embodiment of the present invention in which the Leidenfrost effect is used to drive liquid sample droplets 2 towards the inlet aperture 6 of a mass spectrometer. An inlet tube 8 is arranged upstream of the inlet aperture 6 for receiving the liquid sample 3. The inside of the inlet tube 8 is profiled so as to have a ratchet configuration 10 that includes a series of surfaces that are angled with respect to the longitudinal axis of the tube 8 and which face in a direction towards the inlet aperture 6. The tube 8 is heated to a temperate that is significantly hotter than the temperature at which the liquid sample 3 would boil at. The sample 3 is then injected into the inlet tube 8. As the sample droplets 2 moves towards or into contact with the angled surfaces 10 of the tube, a portion of droplet 2 rapidly vapourises, forming an expanding layer of vapour between the droplet 2 and the angled surface 10. This generates a force on the droplet 2 that propels the droplet 2 in a direction that is perpendicular to the angled surface 10. As the angled surface 10 faces towards the inlet aperture 6, the droplet 2 is propelled in a direction towards the inlet aperture 6. This process is repeated at each angled surface that the droplet 2 approaches on its path through the inlet tube 8, until the droplet 2 is fully vapourised. This technique can be used to desolvate an analyte in a liquid sample 3 containing analyte. This technique is also useful as it enables a liquid sample 3 to be introduced at a location that is remote from the inlet aperture 6.

The sample 3 may be introduced into the inlet tube 8 by direct injection, or by infusion in another liquid or gas stream 12. For example, liquid chromatography eluent may be introduced into the inlet tube 8.

Figure 3:
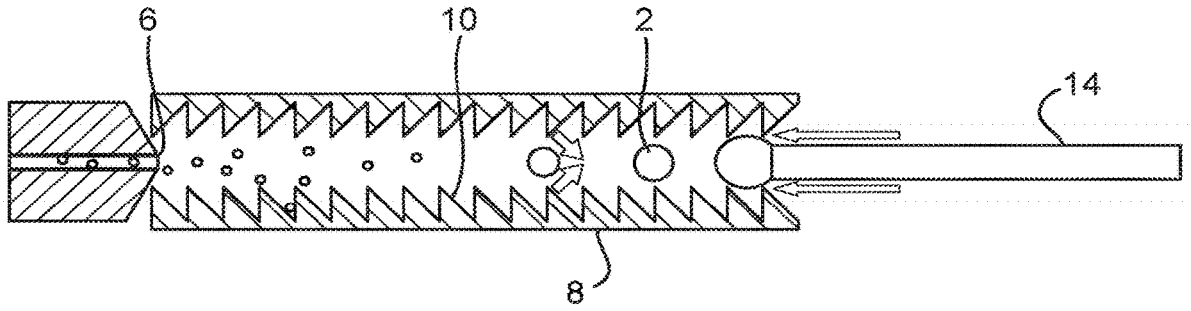
FIG. 3 shows a preferred embodiment of the present invention in which the Leidenfrost effect exerts a force on liquid droplets in a direction away from an inlet aperture of a mass spectrometer.

FIG. 3 shows another embodiment that is the same as that shown in FIG. 2, except that the angled surfaces 10 on the inside of the inlet tube 8 face away from the inlet aperture 6 of the mass spectrometer. Also, the liquid sample introduced into the inlet tube 8 is eluent 14 from a liquid chromatography column. As the angled surfaces 10 on the inside of the inlet tube 8 face away from the inlet aperture 6, the Leidenfrost effect exerts a force of the droplets 2 in a direction away from the inlet aperture 6. Although the net force on the analyte causes the analyte to move towards the inlet aperture 6, the angled surfaces 10 slow the motion of the droplets 2 in the direction towards the inlet aperture 6.

Figure 4:
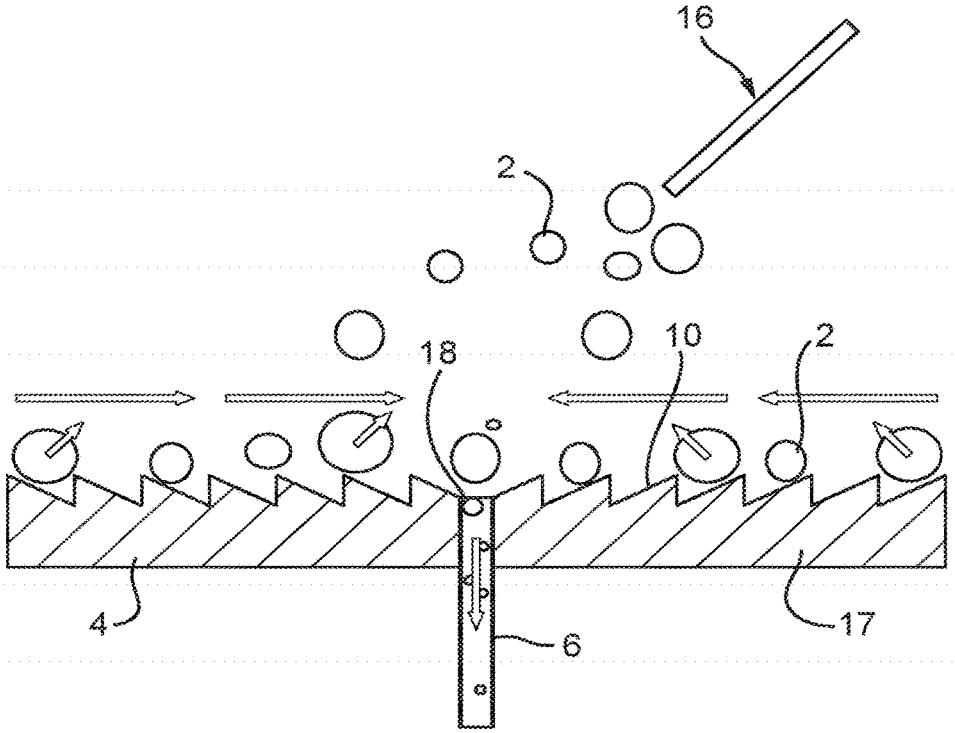
FIG. 4 shows a preferred embodiment of the present invention in which droplets are sprayed onto a plate that urges the droplets towards an inlet aperture of a mass spectrometer by virtue of the Leidenfrost effect.

FIG. 4 shows a cross-sectional view of another embodiment comprising a sprayer 16 for spraying analyte solution droplets 2 and a plate 17 for directing the droplets 2 towards the inlet 6 of a mass spectrometer. The centre of the plate 17 comprises an aperture 18 that is connected to the inlet 6 of the mass spectrometer. The plate 17 is preferably planar and may be any shape such as, for example, circular, square or rectangular. The side of the plate 17 that the analyte is sprayed towards comprises a plurality of angled surfaces 10. Each of the angled surfaces 10 faces in a direction towards the aperture 18 in the plate 17. In operation the plate 17 is heated to a temperate significantly above the temperature that the liquid sample would boil at and sample droplets 2 are sprayed at the plate 17. As in the above embodiments, the heated surface 4 results in the Leidenfrost effect taking place. As the heated angled surfaces 10 are directed towards the aperture 18 in the plate 17, this has the effect that the droplets 2 are directed towards the aperture 18 in the plate 17 whilst they evaporate. The droplets then pass through the aperture 18 in the plate 17 and into the mass spectrometer inlet aperture 6.

Although the plate 17 in this embodiment is depicted with an overall planar shape, it is also contemplated that the overall shape of the plate 17 may be such that droplets 2 are urged in the direction of the inlet aperture 6 under the force of gravity. For example, the overall shape of the plate may be funnel shaped so as to achieve this. Other means of providing a net force on the droplets 2 towards the inlet aperture 6 are also contemplated. For example, a gas flow may be provided that provides a net force on the droplets towards the inlet aperture.

In all embodiments of the present invention, the heated angled surfaces 10 may be arranged such that the Leidenfrost effect generates a force that urges the droplets 2 towards the inlet aperture 6 so as to quicken the motion of the droplets 2 towards the inlet aperture 6. Alternatively, the angled surfaces 10 may be arranged such that the Leidenfrost effect generates a force that urges the droplets 2 away from the inlet aperture 6 so as to slow the motion of the droplets 2 towards the inlet aperture 6.

By shaping the inner surface structure of the inlet tube 8 or the surface of the plate 17 with suitably designed angled surfaces 10, droplets 2 can be propelled in a net direction that is based on the angle of the surfaces 10. The angled surfaces 10 may be arranged and configured in different manners depending on the droplet size incident on the angled surfaces 10 and the solvent characteristics of the sample solution.

The present invention may be used to introduce a sample to the mass spectrometer from a remote location. The present invention may be used to control the transit time and the desolvation rate of the droplets 2.

The geometry of the angled surfaces 10 and/or the temperature of the heated surface 4 provide means for vapourising the liquid to the optimum droplet size for interaction with a surface or for ionisation techniques. For example, the present invention may be used to control the size of the droplets 2 for use in solvent assisted ionisation (SAI), an impactor ion source or rapid evaporation ionisation mass spectrometry (REIMS).

The present invention also provides the advantage that cross-contamination of samples (carryover) may be reduced since the Leidenfrost effect means that each liquid sample does not directly contact the walls of the inlet tube 8 or plate 17.

Although the present invention has been described with reference to preferred embodiments, it will be understood by those skilled in the art that various changes in form and detail may be made without departing from the scope of the invention as set forth in the accompanying claims.

For example, the angled surfaces 10 may be used to move multiple streams of liquid droplets 2 and may be used to urge the streams together so as to mix the droplets 2 from the multiple streams. Moving and mixing multiple liquid droplets streams together may be used to perform on-line chemistries in preparation for mass spectrometry. For example, a MALDI analyte droplet may be mixed with a MALDI matrix. Alternatively, trypsin may be mixed with a sample in order to perform fast digestion of the sample.

The present invention may also be used to manoeuvre liquid droplets 2 to a desired location in a mass spectrometer. For example, the Leidenfrost technique may be used to deposit liquid droplets 2 onto defined regions of a sample plate in preparation for ionisation such as, for example, by MALDI or DESI type surface ionisation.

An electric potential may be applied to the angled surfaces 10 so as to charge the droplets 2. An electric field may then be applied so as to manipulate the charged droplets 2, e.g. in order to focus the stream of droplets 2 and/or improve transmission of the droplet stream through the device.

Using the Leidenfrost phenomena to levitate droplets 2 is advantageous in that the sample is not in direct contact with the walls of the containment vessel or sample plate. Wall-less sample preparation has advantages in that the sample cannot be contaminated or mixed with the remains of other samples. Conventional techniques are known for wall-less sample preparation, but these require complex AC and DC voltages to be applied.

The angled surfaces 10 of the present invention may be hydrophobic surfaces, which may further enhance the repelling effect between the surfaces 10 and the liquid droplets 2.

The transportation of droplets according to the present invention may occur at room temperature. Room temperature desolvation will occur for some solvents that have particularly low boiling points.

The transportation of droplets 2 may occur substantially at atmospheric pressure or at low pressure in a vacuum chamber.

The invention claimed is:

1. A method of mass or ion mobility spectrometry comprising:

supplying liquid comprising an analyte towards a heated surface, wherein the heated surface is heated to a temperature that is sufficiently high to cause a portion of the liquid to vaporise and form vapour between the heated surface and the liquid;

wherein the surface comprises a ratchet shaped profile such that the formation of said vapour repels said liquid away from the heated surface and focuses the analyte into an inlet aperture of a mass or ion mobility spectrometer; and wherein the method comprises urging the liquid along the heated surface and varying a force with which the liquid is urged along the surface so as to control a rate of movement of the liquid along the heated surface and thereby control a rate of evaporation of the liquid.

2. The method of claim 1 comprising urging the liquid along the surface using a gas flow, wherein the step of varying the force with which the liquid is urged along the surface comprises varying the gas flow so as to control the rate of movement of the liquid along the heated surface and thereby control the rate of evaporation of the liquid; or charging the liquid using an electric potential and urging the liquid along the surface using an electric field, wherein the step of varying the force with which the liquid is urged along the surface comprises varying the electric field so as to control the rate of movement of the liquid along the heated surface and thereby control the rate of evaporation of the liquid.

3. The method of claim 1, wherein the ratchet shaped profile is configured such that the formation of said vapour repels said liquid away from the heated surface and radially focuses the analyte into the inlet aperture.

4. The method of claim 1 comprising applying an electric potential to the ratchet shaped profile so as to charge droplets of the liquid; and applying an electric field to further focus the droplets into the inlet aperture.

5. The method of claim 1 wherein the ratchet shaped profile is arranged such that the formation of said vapour urges said liquid along the surface in a direction away from the inlet aperture; and the method comprises:

providing a gas flow that urges the liquid towards the inlet aperture such that net force on the liquid causes it to move towards the inlet aperture; and/or charging the liquid using an electric potential and providing an electric field that urges the liquid towards the inlet aperture such that net force on the liquid causes it to move towards the inlet aperture.

6. The method of claim 1, further comprising subjecting the analyte to an ionisation technique in an ion source located downstream of the heated surface so as to form analyte ions.

7. The method of claim 1, wherein said liquid is provided to said heated surface in the form of liquid droplets.

8. The method of claim 1, wherein the liquid is transported through a tube and said heated surface forms at least part of the inside surface of the tube.

9. The method of claim 6, comprising using the heated surface to urge the liquid into the ion source of the mass or ion mobility spectrometer, ionising the analyte, and using the mass or ion mobility spectrometer to analyse resulting analyte ions.

10. The method of claim 1 wherein the ratchet shaped profile is configured such that the formation of said vapour urges said liquid along the heated surface towards the inlet aperture.

11. A mass spectrometer arranged and configured so as to perform the method of claim 1.

12. A method of mass or ion mobility spectrometry comprising:

supplying liquid comprising an analyte towards a heated surface, wherein the heated surface is heated to a temperature that is sufficiently high to cause a portion of the liquid to vaporise and form vapour between the heated surface and the liquid;

subjecting a sample to liquid chromatography in a liquid chromatography device; and supplying eluent from the liquid chromatography device as said liquid that is supplied towards the heated surface, wherein the surface comprises a ratchet shaped profile such that the formation of said vapour repels said liquid away from the heated surface and focuses the analyte into an inlet aperture of a mass or ion mobility spectrometer, and wherein the liquid is sprayed at said surface.

13. The method of claim 12, comprising directing a laser beam at the liquid in the ion source so as to form the analyte ions from the liquid.

14. The method of claim 12, wherein the heated surface comprises a substantially planar member having the ratchet shaped profile thereon and the inlet aperture therein, and wherein the liquid is moved along the substantially planar member and focused into the inlet aperture in the substantially planar member.

15. The method of claim 12, wherein the analyte is analysed by the mass or ion mobility spectrometer.

16. The method of claim 12, wherein the ratchet shaped profile is configured such that the formation of said vapour repels said liquid away from the heated surface and radially focuses the analyte into the inlet aperture.

17. The method of claim 12, further comprising:

applying an electric potential to the ratchet shaped profile so as to charge droplets of the liquid; and applying an electric field to further focus the droplets into the inlet aperture.

* * * * *